US010369602B2

(12) United States Patent
Falster-Hansen

(10) Patent No.: US 10,369,602 B2
(45) Date of Patent: Aug. 6, 2019

(54) SYSTEM AND METHOD FOR EJECTING LIQUID INTO A CONTAINER FOR MIXING AND CLEANING PURPOSES

(75) Inventor: Henrik Falster-Hansen, Töllöse (DK)

(73) Assignee: ALFA LAVAL CORPORATE AB, Lund (SE)

( * ) Notice: Subject to any disclaimer, the term of this patent is extended or adjusted under 35 U.S.C. 154(b) by 162 days.

(21) Appl. No.: 14/129,759

(22) PCT Filed: Jun. 13, 2012

(86) PCT No.: PCT/EP2012/061183
§ 371 (c)(1),
(2), (4) Date: Dec. 27, 2013

(87) PCT Pub. No.: WO2013/000707
PCT Pub. Date: Jan. 3, 2013

(65) Prior Publication Data

US 2014/0137897 A1 May 22, 2014

(30) Foreign Application Priority Data

Jun. 29, 2011 (EP) ..... 11171881

(51) Int. Cl.
*B08B 9/093* (2006.01)
*B01F 3/08* (2006.01)
(Continued)

(52) U.S. Cl.
CPC ..... *B08B 9/0936* (2013.01); *B01F 3/0865* (2013.01); *B01F 5/0231* (2013.01);
(Continued)

(58) Field of Classification Search
None
See application file for complete search history.

(56) References Cited

U.S. PATENT DOCUMENTS 4,082,057 A 4/1978 Hayes
4,166,704 A 9/1979 Albert
(Continued)

FOREIGN PATENT DOCUMENTS

CN 1211152 C 7/2005
DE 201 13 587 U1 2/2002
(Continued)

OTHER PUBLICATIONS

International Search Report (PCT/ISA/210) dated Aug. 21, 2012, by the European Patent Office as the International Searching Authority for International Application No. PCT/EP2012/061183.
(Continued)

*Primary Examiner* — Mikhail Kornakov
*Assistant Examiner* — Pradhuman Parihar
(74) *Attorney, Agent, or Firm* — Buchanan Ingersoll & Rooney PC

(57) ABSTRACT

A system comprising a mixer with a rotary head fitted with a nozzle for ejecting liquid into a container. At least one drive member rotates the rotary head such that liquid is ejected into the container in a predetermined pattern. A processing unit is configured to receive first and second operation parameters that are representative of mixing of a liquid content of the container respectively cleaning of an inner surface of the container. The processing unit then controls the drive member in response to the operation parameters such that mixing respectively cleaning is effected. A related method and a computer-readable medium are also described.

19 Claims, 2 Drawing Sheets

Figure 1:
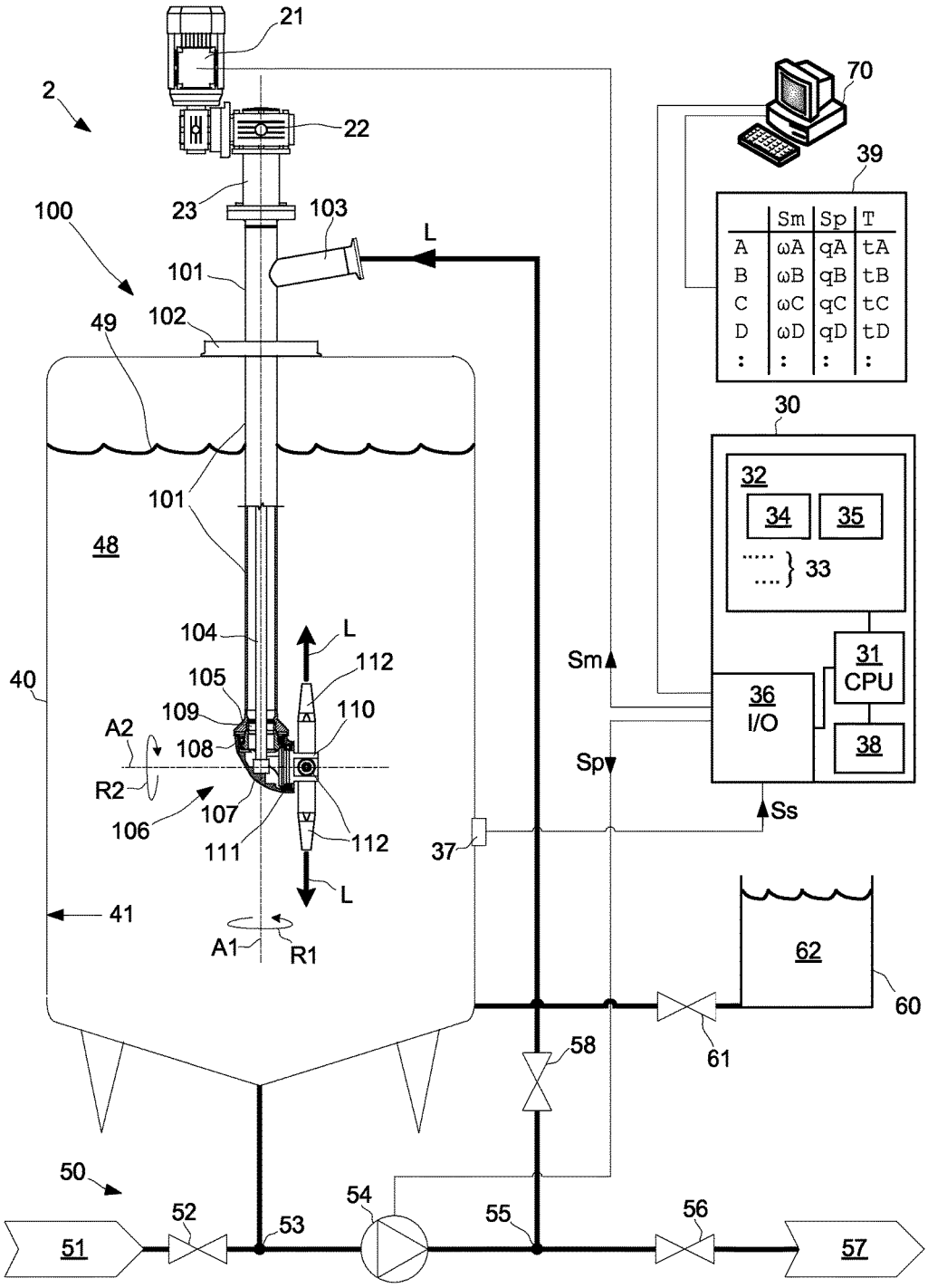

(51) Int. Cl.

| | |
|---|---|
| ***B01F 5/02*** | (2006.01) |
| ***B01F 5/10*** | (2006.01) |
| ***B01F 15/00*** | (2006.01) |

(52) U.S. Cl.

CPC ..... *B01F 5/10* (2013.01); *B01F 15/00032* (2013.01); *B01F 15/00253* (2013.01); *B01F 15/00344* (2013.01); *B01F 15/00389* (2013.01); *B01F 15/00402* (2013.01)

(56) References Cited

U.S. PATENT DOCUMENTS

| | | | | |
|---|---|---|---|---|
| 5,620,250 | A | 4/1997 | Chilcoat et al. | |
| 5,715,852 | A | 2/1998 | Jepsen | |
| 5,896,871 | A | 4/1999 | Larsen | |
| 6,039,056 | A | 3/2000 | Verbeek | |
| 6,431,745 | B1 | 8/2002 | Schlumberger | |
| 6,494,608 | B1 * | 12/2002 | Retamal | B01F 3/088 366/132 |
| 7,713,359 | B2 * | 5/2010 | Jinback | 134/167 R |
| 2002/0144714 | A1 * | 10/2002 | McCasker | 134/22.18 |
| 2003/0207655 | A1 * | 11/2003 | Jackson | B08B 1/00 451/38 |
| 2005/0207268 | A1 * | 9/2005 | Hummer | 366/136 |
| 2006/0253835 | A1 * | 11/2006 | Saelens | B05B 12/085 717/108 |
| 2008/0112259 | A1 * | 5/2008 | Sprinkle | 366/152.3 |
| 2008/0142042 | A1 | 6/2008 | Bramsen | |
| 2009/0173362 | A1 * | 7/2009 | Bramsen | 134/18 |
| 2010/0127015 | A1 * | 5/2010 | Boyer | B67D 1/0036 222/1 |

FOREIGN PATENT DOCUMENTS

| | | | | |
|---|---|---|---|---|
| EP | 1 324 818 | B1 | 11/2004 | |
| EP | 1 884 289 | A2 | 2/2008 | |
| FR | 2797783 | A1 | 3/2001 | |
| FR | 2862241 | A1 | 5/2005 | |
| WO | 0224317 | A1 | 3/2002 | |
| WO | WO 2010/117324 | A1 | 10/2010 | |
| WO | WO-2010117324 | A1 * | 10/2010 | B08B 9/0936 |
| WO | 2010130966 | A1 | 11/2010 | |
| WO | WO 2011/123537 | A1 | 10/2011 | |

OTHER PUBLICATIONS

Written Opinion (PCT/ISA/237) dated Aug. 21, 2012, by the European Patent Office as the International Searching Authority for International Application No. PCT/EP2012/061183.

* cited by examiner

SYSTEM AND METHOD FOR EJECTING LIQUID INTO A CONTAINER FOR MIXING AND CLEANING PURPOSES

TECHNICAL FIELD

The invention relates to a system configured to eject liquid in a container. The system comprises a mixer with an inlet for receiving liquid and a rotary head fitted with a nozzle for ejecting liquid into the container. The system further comprises a drive member for rotating the rotary head about at least one axis such that liquid is ejected into the container in a predetermined pattern.

BACKGROUND ART

Today, various techniques are used for mixing liquids that are stored in tanks, e.g. in process applications where a body of liquid requires equalization of differences in concentration and temperature, intensification of heat transfer, dissolution of a solid, dispersion of immiscible liquids or sparging of a gas.

The requirements are often different in different application areas. For example, in applications with beer fermenters or yeast tanks, mixing is typically applied for obtaining uniformity in concentration of ingredients and temperature. Within food, cosmetics and pharmaceutical industry, mixing of very exact and minute quantities of ingredients into relatively larger volumes of liquid is often performed. Within the pulp and paper, paint, petrochemical, plastics and mining industry, liquids with coarse particles are often mixed. The requirements for obtaining satisfactory mixing thus differ significantly and mixing is often performed by different types of rotary impellers or by liquid ejecting nozzles that are specifically designed for one application area. Baffles are often provided for preventing bulk rotation or swirling of liquid in a tank due to the effect of e.g. a rotating impeller or similar.

Generally, after a liquid has been mixed it is expelled from the tank in which it was mixed and the tank must be cleaned before a next mixing operation may commence. The cleaning should remove residues for a number of reasons such as for avoiding cross contamination, for avoiding build up of contamination layers and for preparing the cleaned tank for another batch of product. A liquid ejected for mixing the liquid content is often of the same type as the liquid content. A liquid ejected for cleaning the tank is generally a cleaning liquid, which gradually may be contaminated with the liquid that is cleaned off from the tank.

Cleaning is accomplished by a number of different arrangements. One such system, relating to cleaning only, is known from US 2009/0173362 A1. The document discloses a tank cleaning verification process. The process involves a spray head having a position, rotation angle and speed externally controllable and detectable from the outside of the tank.

However, in some cases the same arrangement is used for both mixing and cleaning. For example, patent document EP1324818 A1 discloses an arrangement with a jetting device adapted for introducing jets of liquid into a body of liquid inside a tank in order to cause stirring to the body of liquid. A jet nozzle is adapted for rotation about a first axis and about a second axis perpendicular, or non-perpendicular, to the first axis. Upon emptying the tank, the jetting device may serve for cleaning the tank by spraying liquid onto the tank walls.

Other techniques related to mixing or cleaning are described in patent documents U.S. Pat. Nos. 4,166,704 A and 5,620,250 A. US 2005/0207268 A1 relates to combined mixing and cleaning. One or more jets of liquid are introduced into a tank in order to cause agitation and stirring.

The techniques mentioned above are generally capable of mixing a liquid content of a tank (container), and to clean the tank after mixing is complete and the content is expelled.

However, the techniques suffer from an inability to efficiently perform mixing within a wide range of applications areas where different types of liquid contents are mixed, in particular if subsequent cleaning of a tank shall be effected with reasonable effort and/or if time and resources for mixing and cleaning should be kept as low as possible.

SUMMARY

It is an object of the invention to improve the above-identified techniques and prior art. In particular, it is an object to provide a system that, for a large number of applications, effects mixing of a liquid content as well as cleaning of an inner surface of a container while still being relatively efficient in terms of avoiding excessive use of resources.

To fulfill these objects a system that is configured to eject a liquid into a container is provided. The system comprises i) a mixer comprising an inlet for receiving liquid, and a rotary head fitted with a nozzle for ejecting liquid into the container, ii) at least one drive member for rotating the rotary head about at least one axis such that liquid is ejected into the container in a predetermined pattern and iii) a processing unit. The rotary head is arranged to eject the liquid into the container in a first predetermined pattern effecting mixing of the liquid content when the rotary head is submersed in the liquid content, the rotary head being rotated by the at least one drive member controlled by the processing unit in response to a first operation parameter representative of mixing of a liquid content of the container. The rotary head is arranged to eject the liquid into the container in a second predetermined pattern for effecting cleaning of the inner surface of the container after the liquid content is expelled from the container, the rotary head being rotated by the at least one drive member controlled by the processing unit in response to a second operation parameter being representative of cleaning of an inner surface of the container.

The system is advantageous e.g. in that a number of different operation parameters may be received by the processing unit for effecting predetermined patterns of ejected liquid, including patterns for both mixing and cleaning. This facilitates implementation of customized mixing and cleaning for a variety of liquids and tanks, which provides for more efficient use of energy and resources.

The rotary head may eject the liquid into the container when the rotary head and its nozzle are fully submersed in the liquid content.

The drive member may comprise a motor rotating the rotary head about a first axis, and the processing unit may control the motor and thereby the rotation of the rotary head about the first axis.

The drive member may comprise an impeller rotating the rotary head about a second axis in response to a flow of liquid to be ejected into the container. The processing unit may then control a pump that generates the flow of liquid to be ejected into the container, and thereby the impeller and the rotation of the rotary head about the second axis.

The first operation parameter may be indicative of a first rotational speed of the motor and of a first flow rate of a flow of liquid to be ejected into the container.

The second operation parameter may be indicative of a second rotational speed of the motor, which second rotational speed is different from the first rotational speed, and may be indicative of a second flow rate of a flow of liquid to be ejected into the container, which second flow rate is different from the first flow rate.

The system may comprise a memory unit that stores a number of different operation parameters, where each operation parameter is associated with i) a type of operation in form of mixing of a liquid content or cleaning of the inner surface, and ii) a type of a liquid to be mixed or cleaned off from the inner surface.

The processing unit may, in dependence of the type of operation and/or in dependence of the type of liquid, receive from the memory unit an operation parameter that is indicative of a rotational speed of the motor.

The processing unit may be configured to, in dependence of the type of operation and/or in dependence of the type of liquid, receive from the memory unit an operation parameter that is indicative of a flow rate of a flow of liquid to be ejected into the container.

The processing unit may comprise a programmable interface receiving and storing i) operation parameters representative of mixing of a liquid content of the container, and ii) operation parameters representative of cleaning of an inner surface of the container.

The system may comprise a sensor unit that is connected to the tank and configured to send to the processor unit a signal indicative of a property of the liquid content of the tank. The processing unit may then be configured to control the drive member in response to the signal, for altering how liquid is ejected into the container.

According to another aspect of the invention a method for ejecting a liquid in a container is provided. The method is performed by a system comprising i) a mixer having an inlet for receiving liquid, and a rotary head fitted with a nozzle for ejecting liquid into the container, ii) at least one drive member for rotating the rotary head about at least one axis such that liquid is ejected into the container in a predetermined pattern, and iii) a processing unit. The method comprises receiving a first operation parameter representative of mixing of a liquid content of the container when the rotary head is submersed in the liquid content, controlling the drive member in response to the first operation parameter, such that liquid is ejected into the container in a first predetermined pattern and mixing of the liquid content is effected, receiving a second operation parameter representative of cleaning of an inner surface of the container after the liquid content is expelled from the container, and controlling the drive member in response to the second operation parameter, such that liquid is ejected into the container in a second predetermined pattern and cleaning of the inner surface of the container is effected.

The inventive method may include any of the functionality implemented by the features described above in association with the inventive system and shares the corresponding advantages. For example, the method may include a number of steps corresponding to operations of units and devices of the system.

Moreover, according to a further aspect of the invention a computer-readable medium is provided, which stores processing instructions that, when executed by a processing unit, performs the above described method.

Still other objectives, features, aspects and advantages of the invention will appear from the following detailed description, from the attached claims as well as from the drawings.

DRAWINGS

Figure 2:
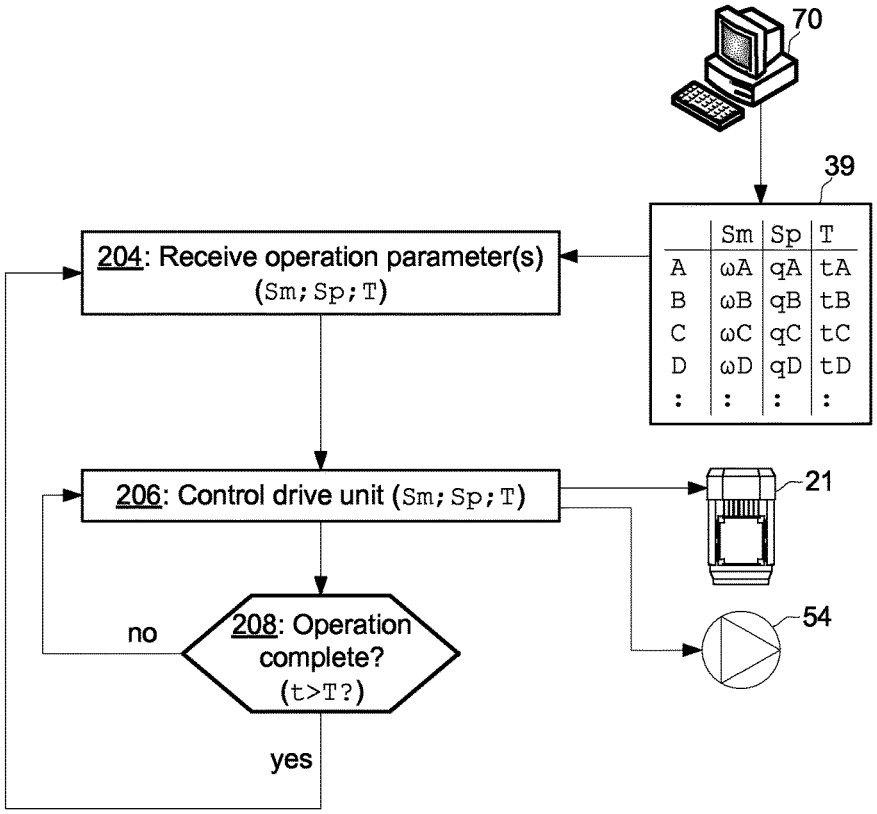
Figure 3:
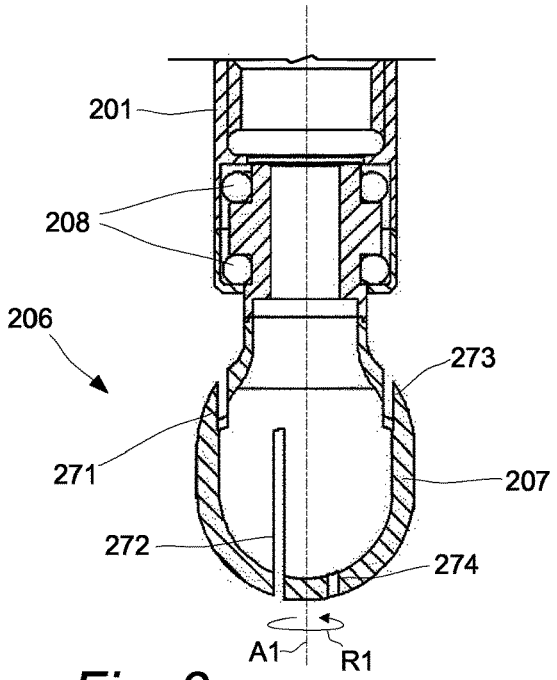

Embodiments of the invention will now be described, by way of example, with reference to the accompanying schematic drawings, in which FIG. 1 is a schematic view of an embodiment of a system configured to eject liquid in a container, FIG. 2 is a flow chart illustrating an embodiment of a method for ejecting liquid in a container, as performed by the system of FIG. 1, and FIG. 3 is an embodiment of an alternative rotary head for the system of FIG. 1.

DETAILED DESCRIPTION

With reference to FIG. 1 an embodiment of a system 2 that is configured to eject a liquid L in a container 40 is illustrated. The system 2 comprises a mixer 100, at least one drive member 21, 109 for the mixer 100, and a processing unit 30 that is configured to control the drive member 21, 109 and thereby a pattern for how liquid L is ejected from the mixer 100 and into the container 40.

In detail, the mixer 100 has a pipe 101 that extends into the container 40 via an opening in an upper part of the container 40. The mixer 100 has a flange 102 that provides a secure connection as well as a tight seal to the container 40. An upper part of the pipe 101 that is outside the container 40 has an inlet 103 for receiving a liquid L. A lower part of the pipe 101 that extends into the container 40 has at its end a connection flange 105 to which a rotary head 106 is connected.

The rotary head 106 comprises a housing 107 that is rotatable around a first axis A1 that is parallel to the pipe 101. A first bearing 108 is arranged in between the connection flange 105 and an inlet end of the housing 107 that faces the connection flange 105, such that the housing 107 is rotatable relatively the connection flange 105.

The rotary head 106 also comprises a rotary hub 110 on which a number of liquid ejection nozzles 112 are arranged. In the illustrated embodiment four nozzles are symmetrically arranged on the rotary hub 110 even though it is possible to have e.g. only one nozzle on the rotary hub 110. A second bearing 111 is arranged in between the rotary hub 110 and an outlet end of the housing 107 that faces the rotary hub 110, such that the rotary hub 110 is rotatable relatively the housing 107. The second bearing 111 allows the rotary hub 110 to rotate about a second axis A2 that is typically offset from the first axis A1 by an angle of 80-100° (90° in the illustrated embodiment). Thus, the rotary hub 110 and the nozzles 112 are able to rotate in a first direction R1 about the first axis A1 and in a second direction R2 about the second axis A2, as seen relative the pipe 101 or relative the container 40.

The inlet 103 and the pipe 101 each have the principal shape of a conventional pipe and are capable of transporting liquid L to be ejected into the container 40. Liquid L enters the inlet 103, is conveyed into the pipe 101 and towards the rotary head 106. Liquid L then enters the rotary head 106 at the housings 107 connection to the connection flange 105 and exits the housing 107 at the housings 107 connection to the rotary hub 110. The rotary hub 110 receives liquid from the housing 107 and distributes liquid L further to the nozzles 112, which eject the liquid L into the container 40 such that liquid L streams into a liquid content 48 of the container 10 or, if the content 48 has been ejected from the container 10, hits an inner surface 41 of the container 40.

The rotation in the first direction R1 about the first axis A1 is accomplished via a shaft 104 that extends from an upper end of the pipe 101 and to the rotary head 106 where it is connected to the housing 107. The shaft 104 has a diameter that is smaller than both an inner diameter of the pipe 101, an inner diameter of the connection flange 105 and a diameter of an opening at the inlet end of the housing 107. This allows liquid L to flow past the shaft 104. When the shaft 104 is rotated, the housing 107 and thereby the rotary head 106 are rotated in the first direction R1.

The pipe 101 is connected to a connection piece 23 and a gearbox 22 is connected to the connection piece 23. The shaft 104 is connected to the gearbox 22, which in turn is connected to a drive member 21. The drive member 21 is here a conventional electrical motor 21, but other types of motors such as a pneumatic motor may be used just as well. When the motor 21 is activated, it generates a rotation of the shaft 104 and thereby a rotation of the rotary head 106 in the first direction R1.

To accomplish the rotation in the second direction R2, a drive member 109 in form of an impeller 109 is arranged inside the housing 107. A rotation of the impeller 109 is induced by a flow of liquid L that passes through the housing 107, from the inlet end to the outlet end of the housing 107. When the impeller 109 rotates, its rotational movement is used for generating a rotation of the rotary head 106, or more specifically, for generating a rotation of the rotary hub 110 in the second direction R2. Any suitable technique for arranging the impeller 109 and for transferring a rotational movement of the impeller 109 to the rotary hub 110 may be employed, such as the technique disclosed in patent document EP1324818 A1, which is incorporated herein by reference.

A liquid circuit 50 is connected to the container 40 and to the mixer 100 for accomplishing a flow of liquid L that shall be ejected from the nozzles 112 and into the container 40. The liquid circuit 50 comprises, in a downstream direction, a liquid source 51, a first valve 52, a first connection point 53, a pump 54, a second connection point 55 and a second valve 58. After the second valve 58 the liquid circuit 50 is connected to the inlet 103 of the mixer 100. A bottom of the container 40 is connected to the liquid circuit 50 at the first connection point 53. A liquid outlet 57 is via a third valve 56 connected to the second connection point 55. A second source of liquid 60 is via a fourth valve 61 connected to the container 40.

The pump 54 may be e.g. a gear pump, a lube pump, a centrifugal pump or a pump of another suitable type. The valves 52, 56, 58, 61 may be butterfly valves, globe valves or valves of another suitable type. A liquid from the liquid source 51 is typically a liquid to be mixed in the container 40 or a liquid that constitutes a major part of a liquid to be mixed in the container 40. A liquid content 62 of the second source of liquid 60 may be a liquid to be mixed with the liquid from the liquid source 51, or it may be a liquid to be used for cleaning of the container 40. Additional liquid sources like the second source of liquid 60 may be connected to the container 40, as required by a predetermined mixing or cleaning application.

By opening the first valve 52 and by closing the second valve 58 and the third valve 56 (or having the pump 54 inactive, depending on pump type), liquid may be fed from the liquid source 51 and into the container 40 via the first connection point 53. In this way the container 40 may be filled with the liquid content 48. The container 40 is typically filled to such an extent that the liquid content 48 completely covers the rotary head 106 and all the nozzles 112. Thus, a surface 49 of the liquid content is well above the rotary head 106 and the nozzles 112.

By closing the first valve 52 and the third valve 56, opening the second valve 58 and operating the pump 54, the liquid content 48 of the container 40 may be circulated via the liquid circuit 50 and the mixer 100. This circulation effects mixing of the liquid content 48 since liquid L then is ejected into the liquid content 48, which efficiently causes the liquid content 48 to be stirred.

By closing the first valve 52 and the second valve 58, opening the third valve 56 and operating the pump 54, the liquid content 48 may be expelled from the container 40 by transporting it to the liquid outlet 57. In this context, when liquid content 48 is expelled, some content is typically still present in the container 40, i.e. expelling a liquid content does not necessarily mean that every part of the liquid content is completely removed from the container 40. Content that is present in the container 40 after the expelling is typically cleaned off in a cleaning process performed by the mixer 100.

The liquid content 62 of the second source of liquid 60 may be introduced in the container 40 by opening the fourth valve 61. If this is done during a mixing operation the liquid content 62 of the second source of liquid 60 is efficiently mixed into the content 48 of the container 10.

When the liquid content 62 of the second source of liquid 60 is a cleaning liquid, then the liquid content 62 is introduced into the container 40 after the (mixed) liquid content 48 is expelled. Cleaning is then effected by closing the first valve 52 and the third valve 56, by opening the second valve 58 and by operating the pump 54. The liquid L is then a cleaning liquid that is expelled into the container 40 and hits the inner surface 41, which efficiently effects cleaning of the inner surface 41. Generally, when cleaning is effected the cleaning liquid in the container 40 does not cover the rotary head 106, i.e. the rotary head 106 and the nozzles 112 are then not submersed in a liquid content.

The motor 21 and the impeller 109 form a drive member 21, 109 that provides the rotations in the first R1 and in the second R2 directions. The mixer 100 comprises the processing unit 30 for controlling the drive member 21, 109. In detail, the processing unit 30 has a central processing unit 31 (CPU) that is connected to and controls an input/output device 36 (I/O). The input/output device 36 is in turn connected to the motor 21 and to the pump 54. The CPU 31 is a central processing unit or microprocessor of a conventional type and represents the portion of the processing unit 30 that is capable of carrying out instructions of a computer program, and is the primary element carrying out the functions of the processing unit 30.

A computer readable medium 32 (also referred to as a memory unit) in the form of e.g. a flash memory, a hard disk or an EEPROM (Electronically Erasable Programmable Read-only Memory) is connected to the CPU 31, and a computer program 33 having software instructions implementing one or more software applications are stored on the computer readable medium 32. The computer readable medium 32 may store various data and control parameters, and the software instructions 33 typically include software instructions that implement the functionality for the processing unit 30 described herein. The software instructions 33 include a module 34 for controlling the motor 21 and a module 35 for controlling the pump 54. In this context, controlling the pump 54 means that a flow of the liquid L is controlled. Since the flow of liquid controls a rotational movement of the impeller 109, the processing unit 30 thereby controls the impeller 109, i.e. the processing unit 30 controls the drive member 109 in form of the impeller.

The processing unit 30 is in addition implemented according to common standards within the field of industrial communication including e.g. Ethernet technology. This includes support for communication with a control station 70 in form of e.g. a conventional personal computer, for example via the input/output device 36. This also includes a capability of the processing unit 30 to send a signal Sm to the motor 21 which in response to the signal Sm operates at a predetermined number of revolutions per minute, as well as a capability to send a signal Sp to the pump 54, which in response to the signal Sp operates at a rate that generates a predetermined flow rate of the flow of the liquid L to be ejected into the container 40.

Also, the processing unit 30 may comprise a programmable interface 38 that allows an operator to input operation parameters in a memory unit like the memory unit 32 and/or in another memory unit like the memory unit 39 described further on. The operation parameters may then be inputted directly by the processing unit 30 or via e.g. the control station 70. The processing unit 30 is thus capable of, i.e. configured to, receive and store operation parameters representative of mixing of a liquid content of the container, respectively operation parameters representative of cleaning of an inner surface of the container. The programmable interface may alternatively be implemented in the control station 70.

The software instructions 33, i.e. a computer program code for carrying out the operations of the processing unit 30 described herein may for development convenience be written in a high-level programming language such as Java, C, and/or C++ but also in other programming languages, such as, but not limited to, interpreted languages. Some modules or routines for the operation of the processing unit 30 may be written in assembly language or micro-code to enhance performance and/or memory usage. It will be further appreciated that functional steps performed by the processing unit 30 may be implemented by using one or more processor, such as e.g. the CPU 31, discrete hardware components, one or more application specific integrated circuits, signal processors or microcontrollers.

The control station 70 has access to a memory unit 39 (i.e. a computer readable medium) in the form of e.g. a flash memory, a hard disk or an EEPROM that stores a number of operation parameters. The operation parameters may be transmitted to and used by the processing unit 30 for operating the drive member 21, 54 in form of the motor 21 and the pump 54. The operation parameters are structured according to a predetermined type of operation (A, B, C, D), where each type of operation represents, i.e. are indicative of, mixing of a predetermined type of liquid or cleaning of predetermined type of liquid. Each type of operation is for this embodiment associated with a rotational speed of the motor 21, a flow rate produced by the pump 54 and possibly also a time value or another stopping criterion that indicates for how long the type of operation shall commence. For example, operation A indicates that the motor 21 shall be operated (run) at a rotational speed of ωA revolutions per minute, that the pump 54 shall produce a flow rate of qA $m^3$/hour of the liquid L, and that the motor 21 and pump 54 shall be operated for tA number of minutes.

A first operation parameter thus comprises operation parameters ωA, qA and optionally also tA. As will be described later, in some embodiments it is sufficient that the first operation comprises only qA. The first operation parameter ωA, qA, tA is, as indicated, associated with a predetermined type of operation A that indicates mixing or cleaning of a predetermined liquid. Correspondingly, a second operation parameter ωB, qB, tB is associated with a predetermined type of operation B (that is different from operation A) indicates mixing or cleaning of a predetermined liquid. ωA, ωB are typically carried to the motor 21 by the signal Sm sent to the motor 21 while qA, qB are carried to the pump via the signal Sp sent to the pump 54.

The disclosed operation parameters serve as an illustrating embodiment and other parameters may be implemented as well. For example, time dependant control parameters may be used, such that the rotational speed of the motor 21 and/or the flow rate of a flow of the liquid L produced by the pump 54 vary over time. This includes that the rotational speed of the motor 21 and/or that the flow rate produced by the pump 54 may be set to zero at periods, for example at regular intervals. In any case, the different operation parameters in the memory unit 39 are still associated with a type of operation in form of mixing of the liquid content 48 or cleaning of the inner surface 41, and with a type of a liquid to be mixed or cleaned off from the inner surface 41. Examples of types of a liquids are beer, milk, crude oil, kerose and all other liquids used in industrial processes where mixing and cleaning are required. Examples of types of operations are mixing, cleaning, different grades and rates of mixing and cleaning.

The memory unit 39 for the operation parameters may be seen as comprised in the system 2 even though it is illustrated as connected to the control station 70. Additionally or alternatively, the control station 70 may be comprised in the system 2. Also, the memory unit 39 for the operation parameters may be omitted by storing the operation parameters directly in the memory unit 32 of the processing unit 30, which then may directly obtain the operation parameters without communicating with the control station 70. In any case, at some point in time the processing unit 30 receives from a memory unit the operations parameters. As described, the ejection into the container 40 may be an ejection that effects either mixing or cleaning.

An effect of predetermined operation parameters is that liquid is ejected into the container 40 in a predetermined pattern. The predetermined pattern determines how well the liquid content 48 is mixed or how well the inner surface 41 of the container 40 is cleaned. The pattern describes, as a function of time, in what directions the liquid L is ejected from the nozzles 112, and is a result of rotations in the directions R1 and R2. Thus, the control of the drive unit 21, 54 causes the liquid L to be ejected into the container 40 in a predetermined pattern. Exactly which predetermined pattern is best for mixing or for cleaning of a certain liquid is typically empirically determined by running the drive unit 21, 54 at different operation parameters and by observing the result for various liquids. When a satisfying result has been found, the operation parameters are noted and stored in the memory unit 39. Reference is made to patent document EP1324818 A1 for more information in respect of ejection of a liquid in a predetermined pattern.

Typically, operation parameters for mixing and cleaning of various liquids may be stored in a knowledge database maintained by a manufacturer of the system 2. The shape of the container 40 may sometimes be relevant for the cleaning or mixing and one knowledge database may then be created for each type of container. In any case, the memory unit 39 may typically be loaded with information from such a knowledge database, which reduces the need of empirically determining suitable operation parameters.

A sensor unit 37 is connected to the tank 40 for sending to the processor unit 30, via the input/output device 36, a signal Ss that is indicative of a property of the liquid content 48 in the tank 40. Examples of properties may be a temperature, a pH-value, a viscosity value, a molecule level indicative of toxins, nutrients, pheromones, glucose, oxygen or osmolality etc., and the sensor unit 37 is of a type that is suitable for detecting one or more of the exemplified properties or another property. The sensor unit 37 is connected to the input/output device 36 that receives the signal Ss. The signal Ss is then indicative of a property of the liquid content 48 of the tank 40, and the processing unit 30 controls the motor 21 and/or the pump 54 in response to the signal Ss. This control typically comprises altering how the liquid L is ejected into the container 40, e.g. by increasing or decreasing a rotational speed of the motor 21 and/or a flow rate produced by the pump 54.

With reference to FIG. 2 a method for ejecting the liquid L into the container 40 is illustrated. The method is performed by the system 2 and comprises a number of iteratively performed steps where, in a first step 204 in a first iteration, the processing unit 30 receives e.g. the first operation parameter ωA, qA, tA associated with operation A. The first operation parameter ωA, qA, tA includes in this embodiment at least one of an operation parameter ωA for the rotational speed of the motor 21 and an operation parameter qA for the pump 54. The first operation parameter may also include a time parameter tA that indicates how long the operations parameters ωA, qA are valid. Generally, the first operation parameter ωA, qA, tA is received by the processing unit 30 and from the memory unit 39, or is directly received or obtained from the memory unit 32 in the processing unit 30 if the parameter is stored there.

In a next step 206 the motor 21 and the pump 54 are controlled according to the first operation parameter, or more precisely according to the operation parameter ωA for the rotational speed of the motor 21 and the operation parameter qA for the pump 54, such that the liquid L is ejected into the container 40 in a first predetermined pattern.

In a final step 208 it is determined if the control of the motor 21 and the pump 54 shall be stopped, i.e. if the ejection of the liquid L is complete. A stopping criteria may include determining of a lapsed time t exceeds the time parameter tA.

Thereafter the method is reiterated and steps 204, 206 and 208 are performed again. However, in the next iteration a new, second operation parameter is received, e.g. the second operation parameter ωB, qB, tB associated with operation B, and the motor 21 and the pump 54 are controlled accordingly until the associated stopping criterion is fulfilled.

Generally, a first operation parameter (associated with e.g. operation A) represents and effects mixing of a liquid content in the container 40 when the rotary head 106 is submersed in the liquid content 48. Naturally, the container 40 is filled with the liquid content 48 before the mixing is performed. A next operation parameter (associated with e.g. operation B) represents and effects cleaning of the inner surface 41 of the container 40. Naturally, between the iterations of the method the mixed content 48 is expelled from the container 40 and a cleaning liquid is ejected or fed into the container 40.

Filling of a content to be mixed, ejecting a mixed content respectively filling and ejecting a cleaning liquid may be accomplished as previously described. The filling and ejection operations are typically controlled by the control station 70, by the control unit 30 or by another system for process control.

With reference to FIG. 3 another embodiment of a rotary head 206 for the system of FIG. 1 is illustrated. The rotary head 206 is arranged at a lower end of a pipe 201 that is similar to the pipe 101 of FIG. 1. The rotary head 206 comprises a ball-shaped body 207 that is connected to the pipe 201 via a bearing 208 that allows the rotary head 206 to rotate in a first direction about an axis A1 that is parallel to the pipe 201. Liquid may enter the rotary head 206 from the pipe 210 and is ejected from the rotary head 206 via a number of slits 271-274 in the body 207. The slits 271-274 eject, in a conventional manner, the fluid in directions that effects a rotational movement of the rotary head 206, and, as known within the art, a predetermined flow of the liquid effects a predetermined rotational speed of the rotary head 206. From this follows that the slits 271-274 form a drive member that provides rotation of the rotary head 206 about the axis A1, such that liquid is ejected into the container in a predetermined pattern.

In this embodiment no motor like the motor 21 of FIG. 1 is required and the processing unit 30 receives a first operation parameter that indicates a flow rate of the liquid L and possibly also a stopping criteria. Naturally, in this case the memory unit 39 does not include any parameter for operating the motor 21 of FIG. 1. Apart from a different rotary head and operation without a motor, the embodiments are similar.

From the description above follows that, although various embodiments of the invention have been described and shown, the invention is not restricted thereto, but may also be embodied in other ways within the scope of the subject matter defined in the following claims. For example, it is possible to use other means for accomplishing rotation of the rotary head in one or more directions, and it suffices that the drive member has only one drive mechanism or structure that provides the rotation of the rotary head.

The invention claimed is:

1. A system configured to eject liquid into a container possessing an inner surface to mix and clean the container, the system comprising a mixer comprising an inlet for receiving liquid, and a rotary head fitted with a nozzle for ejecting liquid into the container and for mixing liquid content in the container, at least one drive member for rotating the rotary head about at least one axis such that liquid is ejected into the container in a predetermined pattern, a processing unit, a memory unit that stores a number of different operation parameters, where each operation parameter is associated with a type of operation in form of mixing of a liquid content or cleaning of the inner surface, and a type of the liquid content to be mixed or cleaned off from the inner surface, the operation parameters stored in the memory unit including: i) a first operation parameter associated with mixing a first liquid content; ii) a second operation parameter associated with mixing a second liquid content that is different from the first liquid content; and iii) a third operation parameter associated with cleaning-off the first liquid content from the inner surface, wherein the rotary head is arranged to eject the liquid into the container in a first predetermined pattern effecting mixing of the first liquid content when the rotary head is submersed in the first liquid content, the rotary head being rotated by the at least one drive member controlled by the processing unit in response to the first operation parameter representative of mixing of the first liquid content of the container, and whereby the rotary head is arranged to eject a cleaning liquid into the container in a second predetermined pattern different from the first predetermined pattern for effecting cleaning of the inner surface of the container after the first liquid content is expelled from the container, the rotary head being rotated by the at least one drive member controlled by the processing unit according to the third operation parameter to clean off the first liquid content from the inner surface of the container.

2. A system according to claim 1, wherein the rotary head ejects the first liquid into the container when the rotary head and its nozzle are fully submersed in the liquid content.

3. A system according to claim 1, wherein the drive member comprises a motor rotating the rotary head about a first axis, and the processing unit controls the motor and thereby the rotation of the rotary head about the first axis.

4. A system according to claim 3, wherein the first operation parameter is indicative of a first rotational speed of the motor and a first flow rate of a flow of the liquid to be ejected into the container to mix the first liquid content.

5. A system according to claim 4, wherein the second operation parameter is indicative of a second rotational speed of the motor, which second rotational speed is different from the first rotational speed, and a second flow rate of a flow of liquid to be ejected into the container to mix the second liquid content, which second flow rate is different from the first flow rate.

6. A system according to claim 1, wherein the drive member comprises an impeller rotating the rotary head about a second axis in response to a flow of liquid to be ejected into the container, and the processing unit controls a pump that generates the flow of liquid to be ejected into the container, and thereby the impeller and the rotation of the rotary head about the second axis.

7. A system according to claim 1, wherein the processing unit, in dependence of the type of operation, receives from the memory unit an operation parameter that is indicative of a rotational speed of the motor.

8. A system according to claim 1, wherein the processing unit, in dependence of the type of operation, receives from the memory unit an operation parameter that is indicative of a flow rate of a flow of liquid to be ejected into the container.

9. A system according to claim 1, wherein the processing unit, in dependence of the type of liquid, receives from the memory unit an operation parameter that is indicative of a rotational speed of the motor.

10. A system according to claim 1, wherein the processing unit, in dependence of the type of liquid, receives from the memory unit an operation parameter that is indicative of a flow rate of a flow of liquid to be ejected into the container.

11. A system according to claim 1, wherein the processing unit comprises a programmable interface receiving and storing operation parameters representative of mixing of a liquid content of the container, and operation parameters representative of cleaning of an inner surface of the container.

12. A system according to claim 1, comprising a sensor unit that is connected to the tank and configured to send to the processing unit a signal indicative of a property of the liquid content of the tank, wherein the processing unit is configured to control the drive member in response to the signal for altering how liquid is ejected into the container.

13. A system according to claim 1, wherein the nozzle is connected to a pump, the first operation parameter associated with mixing the first liquid content including a first rotational speed at which the drive member is rotated during the mixing of the first liquid content and a first flow rate produced by the pump, and the second operation parameter associated with mixing the second liquid content including a second rotational speed at which the drive member is rotated during the mixing of the second liquid content and a second flow rate produced by the pump, the second rotational speed being different from the first rotational speed, and the second flow rate being different from the first flow rate.

14. A method for ejecting liquid in a container, the method performed by a system comprising a mixer having an inlet for receiving liquid, and a rotary head fitted with a nozzle for ejecting liquid into the container, at least one drive member for rotating the rotary head about at least one axis such that liquid is ejected into the container in a predetermined pattern, a processing unit, and a memory unit in which is stored a plurality of different operation parameters, each operation parameter being associated with an operation that is either mixing liquid content in the container or cleaning an inner surface of the container, and a type of a liquid content to be mixed in the container or cleaned off from the inner surface of the container, the method comprising receiving a first one of the operation parameters representative of mixing of a liquid content of the container when the rotary head is submersed in the liquid content, controlling the drive member in response to the first operation parameter, such that liquid is ejected into the container in a first predetermined pattern and mixing of the liquid content is effected, receiving a second one of the operation parameters representative of cleaning of the inner surface of the container after the liquid content is expelled from the container, the second one of the operation parameters being different from the first one of the operation parameters and controlling the drive member in response to the second operation parameter, such that liquid is ejected into the container in a second predetermined pattern and cleaning of the inner surface of the container is effected.

15. A computer-readable medium storing processing instructions that, when executed by a processing unit, performs the method according to claim 14.

16. The method according to claim 14, wherein the first one of the operation parameters representative of mixing of a liquid content of the container is an operation parameter representative of mixing of a first liquid content of the container, further comprising receiving a third one of the operation parameters representative of mixing of an other liquid content of the container that is different from the first liquid content, and controlling the drive member in response to the third operation parameter such that liquid is ejected into the container and mixing of the other liquid content is effected.

17. A system configured to eject liquid into a container possessing an inner surface to mix or clean the container, the system comprising:

a mixer comprising an inlet connectable to a pump for receiving liquid, and a rotary head fitted with a nozzle for ejecting liquid into the container;

a motor operatively connected to the rotary head for rotating the rotary head about at least one axis such that liquid is ejected into the container;

a processing unit;

memory in which is stored a plurality of different operation parameters, each stored operation parameter being associated with: i) a mixing operation in which the liquid in the container is mixed or a cleaning operation in which the inner surface of the container is cleaned; and ii) a type of a liquid to be mixed or cleaned off from the inner surface of the container;

the plurality of different operation parameters stored in the memory including one operation parameter identifying a first mixing operation for a first type of liquid so that the first type of liquid is mixed according to a first set of parameters, the first set of parameters including a first rotation speed of the motor and a first flow rate of the pump;

the plurality of different operation parameters stored in the memory also including a second operation parameter identifying a second mixing operation for a second type of liquid so that the second type of liquid is mixed according to a second set of parameters, the second set of parameters including a second rotation speed of the motor and a second flow rate of the pump, the second rotation speed of the motor being different from the first rotation speed of the motor, the second flow rate of the pump being different from the first flow rate of the pump, the second type of liquid being different from the first type of liquid; and the plurality of different operation parameters stored in the memory also including a third operation parameter identifying a cleaning operation for the first type of liquid so that the first type of liquid is cleaned off the inner surface of the container according to a third set of parameters, the third set of parameters including a third rotation speed of the motor and a third flow rate of the pump, the third rotation speed of the motor being different from the first rotation speed of the motor, the third flow rate of the pump being different from the first flow rate of the pump.

18. A system according to claim 17, wherein the first set of parameters includes a first time period during which the mixing of the first type of liquid is carried out, and the second set of parameters includes a second time period during which the mixing of the second type of liquid is carried out, the first time period being different from the second time period.

19. A system according to claim 17, wherein the plurality of different operation parameters include a cleaning operation parameter identifying a cleaning operation involving the first type of liquid that is to be cleaned off the inner surface of the container.

* * * * *